United States Patent [19]

Iwata

[11] 4,289,454

[45] Sep. 15, 1981

[54] ROTARY HYDRAULIC DEVICE

[75] Inventor: Hiroto Iwata, Higashimatsuyama, Japan

[73] Assignee: Jidosha Kiki Co., Ltd., Tokyo, Japan

[21] Appl. No.: 79,770

[22] Filed: Sep. 28, 1979

[30] Foreign Application Priority Data

Oct. 3, 1978 [JP] Japan ..... 53-121689

[51] Int. Cl.[3] ..... F04B 49/00

[52] U.S. Cl. ..... 417/300; 417/310

[58] Field of Search ..... 417/300, 307, 310; 418/268, 82; 137/115, 117

[56] References Cited

U.S. PATENT DOCUMENTS

| | | | |
|---|---|---|---|
| 3,433,240 | 3/1969 | Lehmann | 417/307 X |
| 3,671,143 | 6/1972 | Clark | 417/310 X |
| 3,953,153 | 4/1976 | Huber et al. | 417/310 X |

*Primary Examiner*—Carlton R. Croyle
*Assistant Examiner*—Edward Look
*Attorney, Agent, or Firm*—Neil F. Markva

[57] ABSTRACT

A rotary hydraulic device in which a pair of delivery ports of a vane pump communicate with independently separated delivery chambers, respectively, and the communication between one of the delivery chamber and a hydraulic machine is shut off after the flow rate of delivery fluid from the delivery port exceeds a certain level with the increase in the speed of rotation of the pump. The excess fluid from the delivery port is returned to the tank side which causes the decrease of the supply flow rate in the zone of high speed rotation of the pump and also the reduction of power consumption so that the rotary hydraulic device of the invention is especially suitable for the power steering devices of vehicles.

6 Claims, 8 Drawing Figures

ROTARY HYDRAULIC DEVICE

BACKGROUND OF THE INVENTION

1. Field of the Invention

The present invention relates to a rotary hydraulic device which utilizes a what is called balanced-type vane pump. More particularly, the invention relates to a rotary hydraulic device which is suitable for the power steerings of vehicles since the reduction of power consumption can be attained by restricting the increase of flow rate with the rise in the speed of rotation.

2. Description of the Prior Art

The delivery rate of a pump is varied in proportion to the speed of rotation thereof. In the pump which is mounted on a vehicle and is driven by the engine of the vehicle, the capacity of the pump must be made sufficient to supply necessary hydraulic fluid to the hydraulic machine such as a power steering device of the vehicle even when the speed of rotation of the engine is low, that is, when the rate of delivery of the pump is small. However, if the capacity of the pump is set to such the level, the hydraulic machine is supplied with excess fluid during the high speed rotation of the engine, which is wasteful.

In the conventional art, therefore, the delivery side of the pump is provided with a flow control valve and when the delivery of the pump exceeds a certain level, the excess fluid is returned to the tank, thereby maintaining the supply rate to the hydraulic machine at a constant level. In other pump device, after the supply rate is maintained at a certain level, the flow rate is further reduced. (For example, U.S. Pat. Nos. 3,426,785 and 3,314,495).

Nevertheless, since these flow control valves are actuated in response to the variation of the rate of delivery regardless of the pressure of the fluid delivered from the pump, the delivery quantity is large, and when the hydraulic machine is worked under the condition in which the fluid quantity is maintained below a certain level and the fluid pressure on the pump side is raised, the raised pressure works on all the pressurized fluid delivered from the pump. As the result, the pump must deliver a large quantity of high pressure fluid, which increases the power consumption of the engine. Further, the structure of the control valve of the above pump device in which the flow rate can be reduced, is complicated and the mechanical noises and pulsation are large, is addition, the flow rate to the hydraulic machine is liable to be varied by the fluctuation of pressure.

SUMMARY OF THE INVENTION

It is, therefore, the primary object of the present invention to eliminate the above-described disadvantages in the conventional devices.

Another object of the present invention is to reduce the supply quantity of hydraulic fluid and also to reduce the power consumption after the delivery quantity of the pump is increased.

In view of the structure of the conventional vane pump, that is, the pump has a pair of delivery ports, another object of the present invention is to reduce the supply quantity of hydraulic fluid and also to reduce the power consumption after the delivery quantity is increased, by connecting only one of the delivery ports to the hydraulic machine.

A further object of the present invention is to provide a unified and simplified rotary hydraulic device in which the control valve is mounted in the body of vane pump.

Still a further object of the present invention is to provide a rotary hydraulic device in which the connecting state and flow quantity between the hydraulic machine and the two delivery ports of the vane pump are regulated by a single control valve.

These and other objects, features and effects of the present invention will be more apparent by the following description with reference to the accompanying drawings.

DESCRIPTION OF PREFERRED EMBODIMENTS

Figure 1:
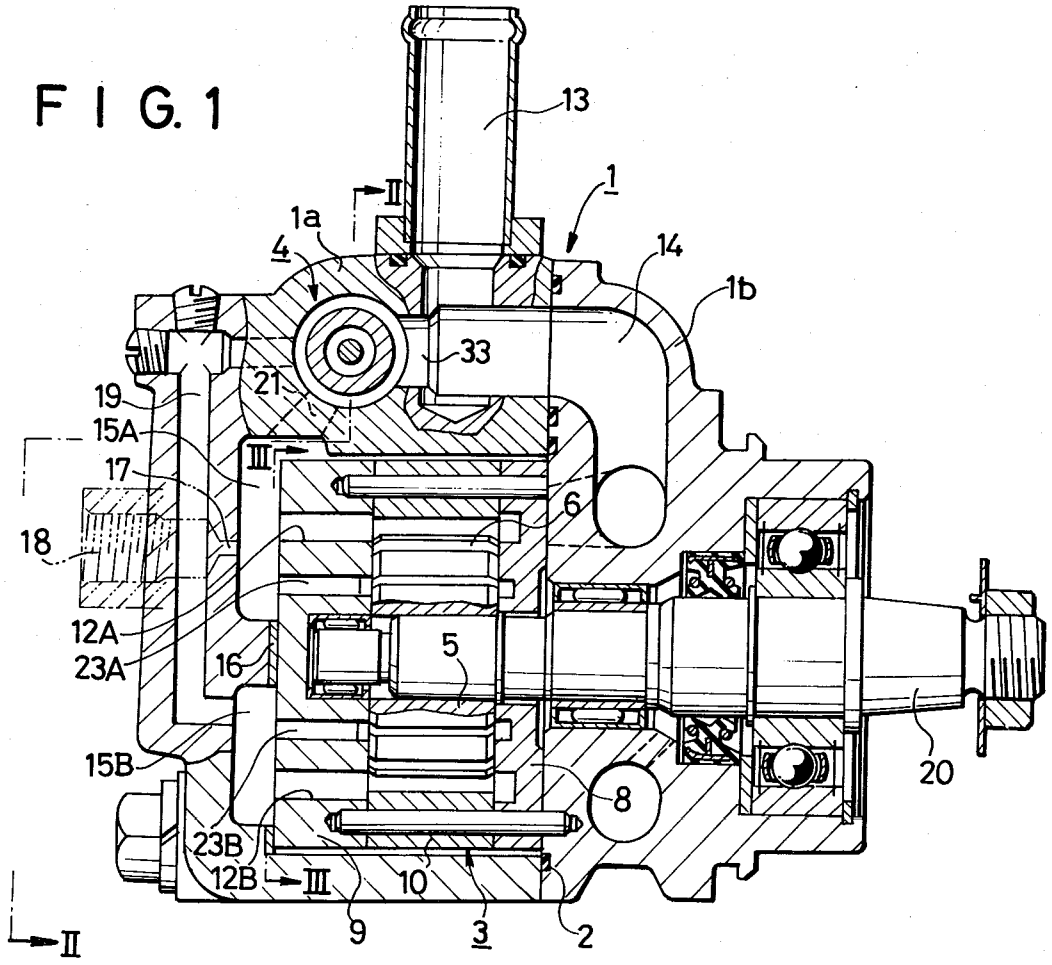
FIG. 1 is a vertical cross-sectional view of the main portion of an embodiment of the rotary hydraulic device of the present invention.
Figure 2:
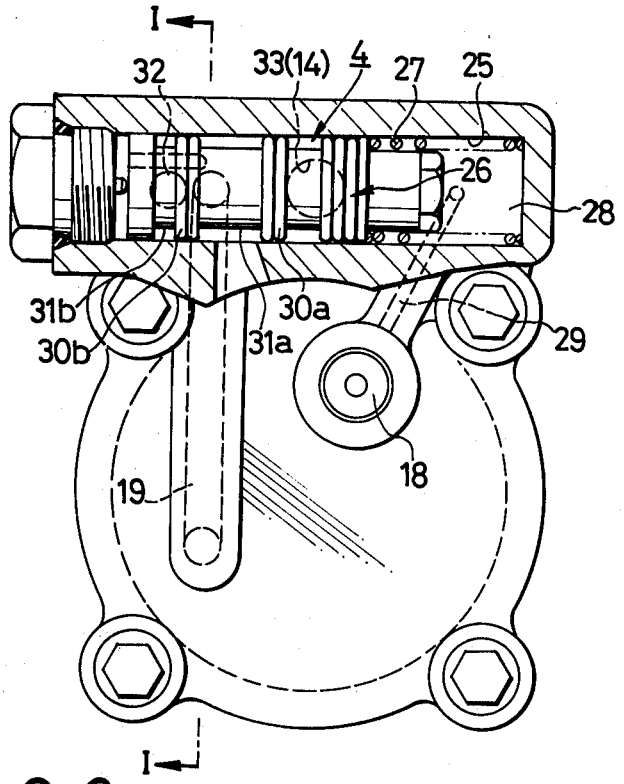
FIG. 2 is a left side view of the same embodiment in which a portion is indicated in cross-section that is taken along the line II—II in FIG. 1.
Figure 3:
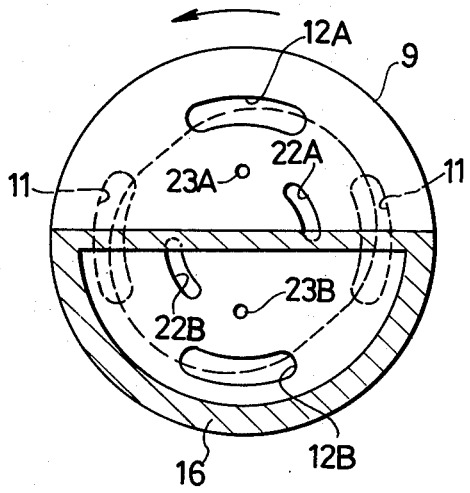
FIG. 3 is a cross sectional view of the same embodiment taken along the line III—III in FIG. 1.
Figure 4A:
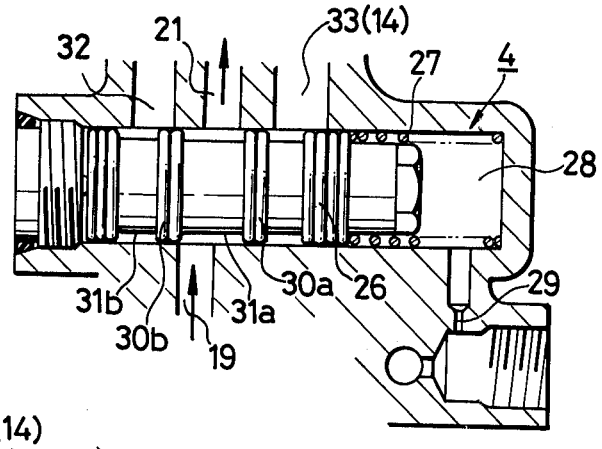
FIGS. 4 (A), 4 (B), 4 (C) and 4 (D) are the cross-sectional views of the control valve as shown in FIG. 2, in which the operation conditions are indicated sequentially.
Figure 4B:
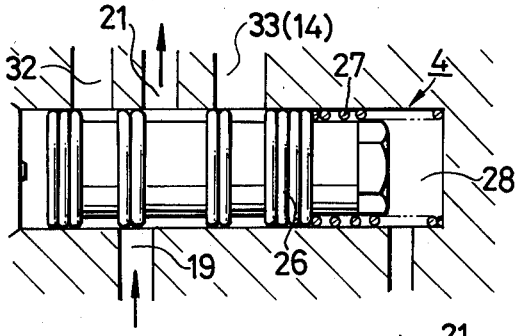
Figure 4C:
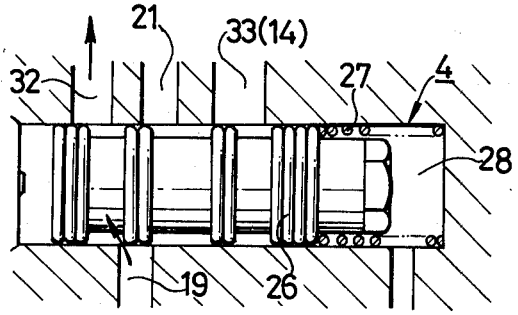
Figure 4D:
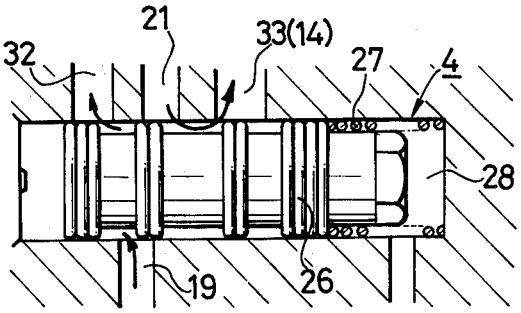

In FIGS. 1 and 2, the reference numeral 1 denotes a casing body which is composed of a rear body 1*a* and a front body 1*b* with interposing sealing members 2 therebetween. Mounted in the casing body 1 are a vane pump 3 and a control valve 4. As being well known, the vane pump 3 is composed of a rotor 5, vanes 6 which are slidably fitted in the grooves that are radially defined in the rotor 5, a side plate 8 and a pressure plate 9 which are disposed on both side faces of the rotor 5, respectively, and an annular cam ring 10 which is brought into slidable contact with the vanes disposed between both the plates 8 and 9. The side plate 8 is provided with intake ports 11 at the axially symmetrical positions relative to the rotor 5. While, the pressure plate 9 is provided with delivery ports 12A and 12B which are disposed at the axially symmetrical positions to the rotor 5 and are shifted by 90 degrees from the inlet ports 11 (see FIG. 3). The reference numeral 13 denotes an inlet port for a hydraulic fluid, which inlet port 13 communicates with the intake ports 11 through inner passages 14.

In the present invention, the above two delivery ports 12A and 12B communicates with the delivery chambers 15A and 15B which are separately formed in the rear body 1*a*. The reference numeral 16 denotes a gasket which separates both the delivery chambers 15A and 15B. One chamber 15A of the delivery chambers 15A and 15B is allowed to communicate through a metering orifice 17 to a supply passage 18 and to a hydraulic machine. The other delivery chamber 15B communicates with the delivery chamber 15A through an inner passage 19 in the rear body 1*a*, the control valve 4 and another inner passage 21. In other words, the delivery chamber 15B communicates with the above-mentioned supply passage 18 by way of the control valve 4 and the delivery chamber 15A. Further, in FIG. 3, the reference numerals 22A and 22B denote hydraulic fluid inlets which lead the hydraulic fluids in the respective delivery chambers 15A and 15B to the back sides of the vanes 6. The throttles 23A and 23B are formed in the pressure plate 9 and back pressure is applied to the vanes through the throttles 23A and 23B.

In the control valve 4, a spool 26 is slidably fitted in the bore 25 which is formed in the rear body 1*a* and the spool 26 is urged in one direction by means of a return spring 27. The chamber 28 that holds the return spring 27 communicates with the downstream side of the metering orifice 17 through the passage 29 (see FIG. 2). Around the spool 26, there are formed lands 30A and 30*b* and annular grooves 31*a* and 31*b* between the lands. In accordance with the sliding position of the spool 26, the communication between the above inner passage 19 and inner passage 21 or the passage 32 on the suction side (on the side of the tank), or the communication between the inner passage 21 and the opening 33 of the inner passage 14 on the suction side (the tank side), can be controlled as described below, thereby regulating the flow quantity to the supply passage 18.

In the rotary hydraulic device of the present invention having the above-described structure, when the rotor 5 is rotated by means of a driving shaft 20, the hydraulic fluid is led into the rotor chamber which is composed of the vanes 6 adjoining around the rotor 5, the outer surface of the rotor 5 and the inner surface of the cam ring 10, through the inlet tube 13, inner passages 14 and intake ports 11, and the hydraulic fluid is then discharged through the two delivery ports 12A and 12B. The delivery ports 12A and 12B communicate with the separate delivery chambers 15A and 15B, respectively, and the delivery chamber 15A directly communicates with the supply passage 18, while since the delivery chamber 15B communicates with the supply passage 18 through the control valve 4 and the delivery chamber 15A, the hydraulic fluid from the delivery chamber 15B is positively led into the control valve 4. However, since the flow rate of the fluid through the metering orifice 17 of the supply passage 18 is low when the speed of rotation of the rotor 5 is low, the spool 26 which is actuated by the pressure difference between the front and rear sides of the orifice 17 is retained at the rest position as shown in FIGS. 2 and 4 (A). Accordingly, the inner passage 19 communicates with only the inner passage 21 by means of the annular groove 31*a* and the lands 30*a* and 30*b* of the spool 26, so that all the hydraulic fluid from the delivery chamber 15B is led into the delivery chamber 15A and is merged into the hydraulic fluid in the delivery chamber 15A, and they are then led into the supply passage 18. (In the zone A of FIG. 5, the dash line q indicates the flow rate of the fluid from the delivery chamber 15B and the solid line Q indicates the flow rate of the total fluid from both the delivery chambers 15A and 15B. The same shall apply hereinafter.)

When the flow rate through the metering orifice 17 of the supply passage 18 exceeds a certain level, the pressure difference between the front and rear sides of the orifice 17 increases which causes the spool 26 to move against the force of the return spring 27. With the shifting of the spool 26, the land 30*b* of the spool 26 gradually reduces the communicating area between the inner passages 19 and 21 as shown in FIGS. 4 (B) and 4 (C), and the communicating area is finally closed. Simultaneously with the above working, the inner passage 19 is caused to communicate with the passage 32 on the suction side through the annular groove 31*b* by the land 30*b*, and the communicating area is gradually enlarged. Therefore, the quantity of the hydraulic fluid from the delivery chamber 15B to the inner passage 21 which communicates with the delivery chamber 15A is gradually reduced, while the rate of return flow to the tank side is increased. Accordingly, the quantity of hydraulic fluid supplied from the delivery chamber 15B to the supply passage 18 is decreased as shown by the dash line q in the zone B of FIG. 5 and it becomes finally zero (point D of FIG. 5). The sum of the supplied fluid from the delivery chamber 15A which increases with the rise of the speed of rotation of the rotor 5 and the fluid from the delivery chamber 15B, is shown by the solid line Q which is on an almost constant level.

When the speed of rotation of the rotor 5 is raised with the rightward shifting of the spool 26 from the position of FIG. 4 (C), the land 30*a* connects the inner passage 21 to the opening 33 of the suction side passage 14 through the annular groove 31*a* as shown in FIG. 4 (D) and the communicating area is gradually enlarged. Accordingly, a part of the hydraulic fluid from the delivery chamber 15A is returned to the suction side of the pump through this communicating passage, so that, in spite of the increase in the rotational number of the rotor 5, the fluid quantity to the supply passage 18 becomes almost constant (zone C in FIG. 5). By the way, in this zone, the hydraulic fluid delivered from the delivery chamber 15B is totally returned to the tank side through the inner passage 19, the annular groove 31*b* of the spool 26 and the suction side passage 32, thus the communication between the delivery chambers 15A and 15B is closed. Accordingly, in such the state, even when the hydraulic pressure is raised in the hydraulic devices which are connected to the supply passage 18, the rise of pressure gives an influence only to the delivery chamber 15A, while the delivery chamber 15B is free from such the rise of the hydraulic pressure, and the required power can be reduced by about half as compared with the conventional device in which the whole delivery becomes high pressure. The solid line P and the dash line p respectively indicates the required powers for the device of the present invention and for the conventional device in the case that the pressure for hydraulic devices is 30 $Kg/cm^2$, from which the effect in the reduction of power consumption will easily be understood. The reduction in the power consumption is profitable not only in the saving of energy but also in the prevention of the seizure of pumps by the rise in temperature of hydraulic fluids, the deterioration of hydraulic fluids and the wearing of sliding members, thereby improving the durability and reliability of hydraulic devices.

Figure 5:
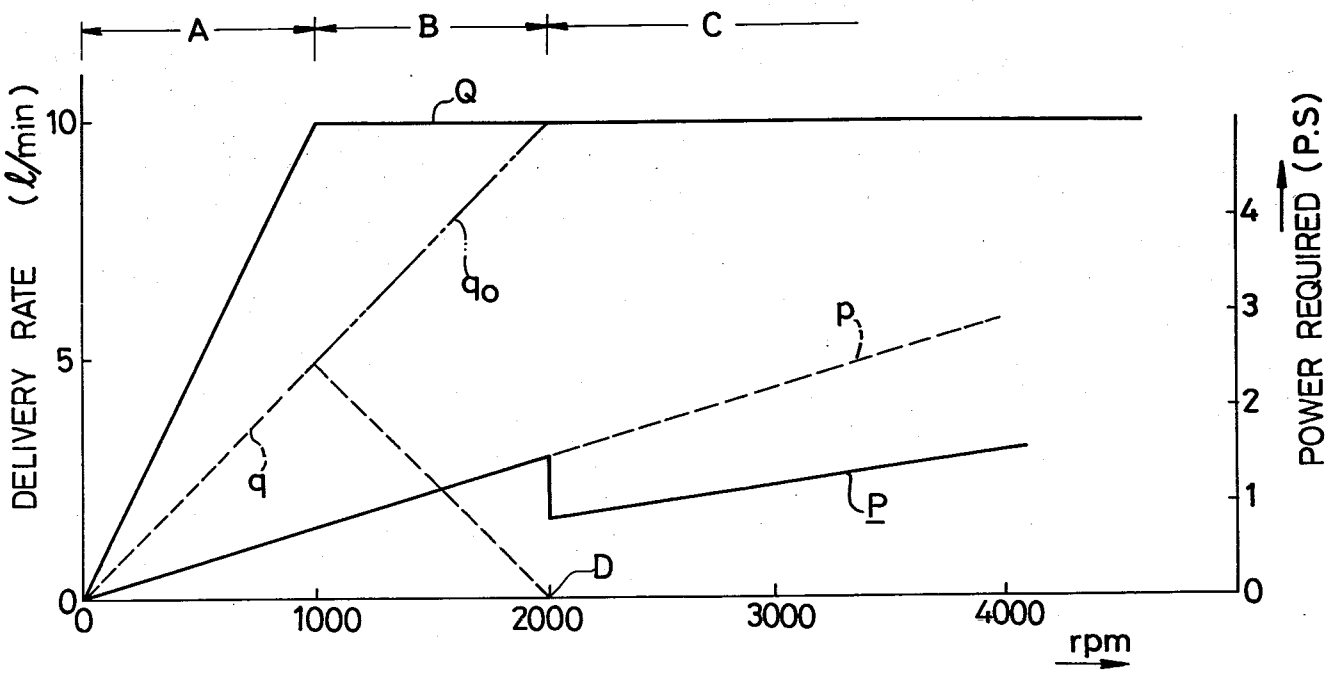
FIG. 5 is a graph showing characteristic curves of the delivery rates and power consumption of the rotary hydraulic device of the present invention.

Furthermore, it should be noted that the control valve in the above embodiment is only an example and several kinds of other conventional control valves may be likewise employed in the present invention. Especially, when the conventional control valve having the characteristic that the flow rate decreases (drooping) in the zone C of FIG. 5, is used, it is ideal as the device for power steerings. To the contrary, it is possible to constitute the control valve as only a changeover valve.

While the present invention has been described with reference to particular embodiment thereof, it should be understood that other changes and modifications will readily occur to those skilled in the art and hence the invention is not limited to the specific embodiment described herein, but is solely defined by the appended claims.

What is claimed is:

1. A rotary hydraulic device comprising:

(a) a vane pump disposed in a casing and including a rotationally driven rotor having a plurality of radially disposed grooves, (b) a plurality of vanes slidably fitted into said grooves, (c) a cam ring in slidable contact with said grooves, (d) a pair of delivery ports formed at symmetrical positions with respect to said rotor, said ports direct a fluid into a chamber which is formed by said rotor, vanes and cam ring and discharge said fluid therefrom, (e) a pair of independently separated delivery chambers communicate with said delivery ports, respectively, (f) a control valve which shuts off the communication between one of said pair of delivery chambers and a hydraulic machine and returns the excess fluid from said delivery chamber to the tank side, (g) a pressure plate including a pair of delivery ports, said pressure plate being in slidable contact with the end faces of said rotor and vanes, and (h) a sealing member surrounds one delivery port and is interposed between said casing and said pressure plate.

2. A rotary hydraulic device comprising:

(a) a vane pump disposed in a casing and including a rotationally driven rotor having a plurality of radially disposed grooves, (b) a plurality of vanes slidably fitted into said grooves, (c) a cam ring in slidable contact with said grooves, (d) a pair of delivery ports formed at symmetrical positions with respect to said rotor, said ports direct a fluid into a chamber which is formed by said rotor, vanes and cam ring and discharge said fluid therefrom, (e) a pair of independently separated delivery chambers communicate with said delivery ports, respectively, (f) a control valve which shuts off the communication between one of said pair of delivery chambers and a hydraulic machine and returns the excess fluid from said delivery chamber to the tank side, (g) said casing including a supply passage to said hydraulic machine, (h) an orifice has front and rear sides and is disposed in said supply passage, (i) said control valve is composed of a spool valve which is actuated by the pressure difference between the front and rear sides of said orifice, and (j) said spool valve controls the communicating states of the passages among said pair of delivery chambers, hydraulic machine and the side of the tank.

3. The rotary hydraulic device as claimed in either one of claims 1 or 2, wherein one delivery chamber of said delivery chambers directly communicates with said hydraulic machine, while the other delivery chamber communicates with said one delivery chamber through said control valve.

4. The rotary hydraulic device as claimed in either one of claims 1 or 2, wherein said control valve is held in the casing in which a vane pump is mounted.

5. The rotary hydraulic device as claimed in either one of claims 1 or 2, wherein said hydraulic machine is a power steering of a vehicle and the rotor of said vane pump is driven by the engine of said vehicle.

6. The rotary hydraulic device as claimed in claim 2, wherein said spool valve shuts off the communication between one delivery chamber and said hydraulic machine in accordance with the increase of delivered fluid from said delivery port, then controls to make constant the rate of flow from the other delivery chamber to said hydraulic machine.

* * * * *